US009416672B2

(12) United States Patent
Feldmann et al.

(10) Patent No.: US 9,416,672 B2
(45) Date of Patent: Aug. 16, 2016

(54) HOUSING STRUCTURE WITH IMPROVED SEAL AND COOLING

(71) Applicant: MTU AERO ENGINES AG, Munich (DE)

(72) Inventors: Manfred Feldmann, Eichenau (DE); Janine Sangl, Dachau (DE); Sebastian Kaltenbach, Munich (DE); Joachim Lorenz, Altomunster (DE)

(73) Assignee: MTU AERO ENGINES AG, Munich (DE)

( * ) Notice: Subject to any disclaimer, the term of this patent is extended or adjusted under 35 U.S.C. 154(b) by 327 days.

(21) Appl. No.: 14/052,338

(22) Filed: Oct. 11, 2013

(65) Prior Publication Data

US 2014/0102107 A1 Apr. 17, 2014

(30) Foreign Application Priority Data

Oct. 12, 2012 (EP) ..... 12188313

(51) Int. Cl.

| | |
|---|---|
| ***F01D 9/02*** | (2006.01) |
| ***F01D 11/00*** | (2006.01) |
| ***F01D 25/24*** | (2006.01) |
| ***F01D 9/04*** | (2006.01) |

(52) U.S. Cl.

CPC ..... *F01D 9/023* (2013.01); *F01D 9/041* (2013.01); *F01D 11/005* (2013.01); *F01D 25/243* (2013.01); *F05D 2240/15* (2013.01)

(58) Field of Classification Search

CPC ..... F02C 7/24; F02C 7/28; F05D 2260/30; F01D 9/02; F01D 9/00; F01D 9/023; F01D 9/06; F01D 9/065; F01D 11/005; F01D 25/14; F01D 25/145; F01D 25/246; F01D 25/243

See application file for complete search history.

(56) References Cited

U.S. PATENT DOCUMENTS

| | | | | |
|---|---|---|---|---|
| 6,575,697 | B1 | 6/2003 | Arilla et al. | |
| 6,666,645 | B1 * | 12/2003 | Arilla | F01D 11/24 415/116 |
| 2002/0122716 | A1 | 9/2002 | Beacock et al. | |
| 2007/0231123 | A1 | 10/2007 | Dervaux | |
| 2008/0080970 | A1 * | 4/2008 | Cooke | F01D 9/042 415/173.3 |
| 2012/0134788 | A1 * | 5/2012 | Taillant | F01D 9/042 415/178 |
| 2012/0189426 | A1 * | 7/2012 | Thibodeau | F01D 11/08 415/1 |
| 2012/0247124 | A1 * | 10/2012 | Shapiro | F01D 9/04 60/805 |

FOREIGN PATENT DOCUMENTS

EP 1384858 A2 1/2004

OTHER PUBLICATIONS

European Patent Office; Ingo Mielimonka; European Search Report of related application EP 12 18 8313; Oct. 21, 2013; 7 pages.

* cited by examiner

*Primary Examiner* — Andrew Nguyen
(74) *Attorney, Agent, or Firm* — Howison & Arnott, LLP

(57) ABSTRACT

A housing structure for a turbo-engine, especially for a gas turbine or an aircraft engine, includes an outer housing wall and an inner housing wall, the inner and outer housing walls annularly enclosing a flow channel for the turbo-engine and being spaced apart radially from the flow channel. At least one heat shield is arranged between the inner and outer housing walls, and a bar or a fixture projects at least somewhat radially from the inner housing wall. The bar or the fixture has on at least one side a broadening element that includes a sealing face against which the heat shield is positioned in a sealing manner.

10 Claims, 1 Drawing Sheet

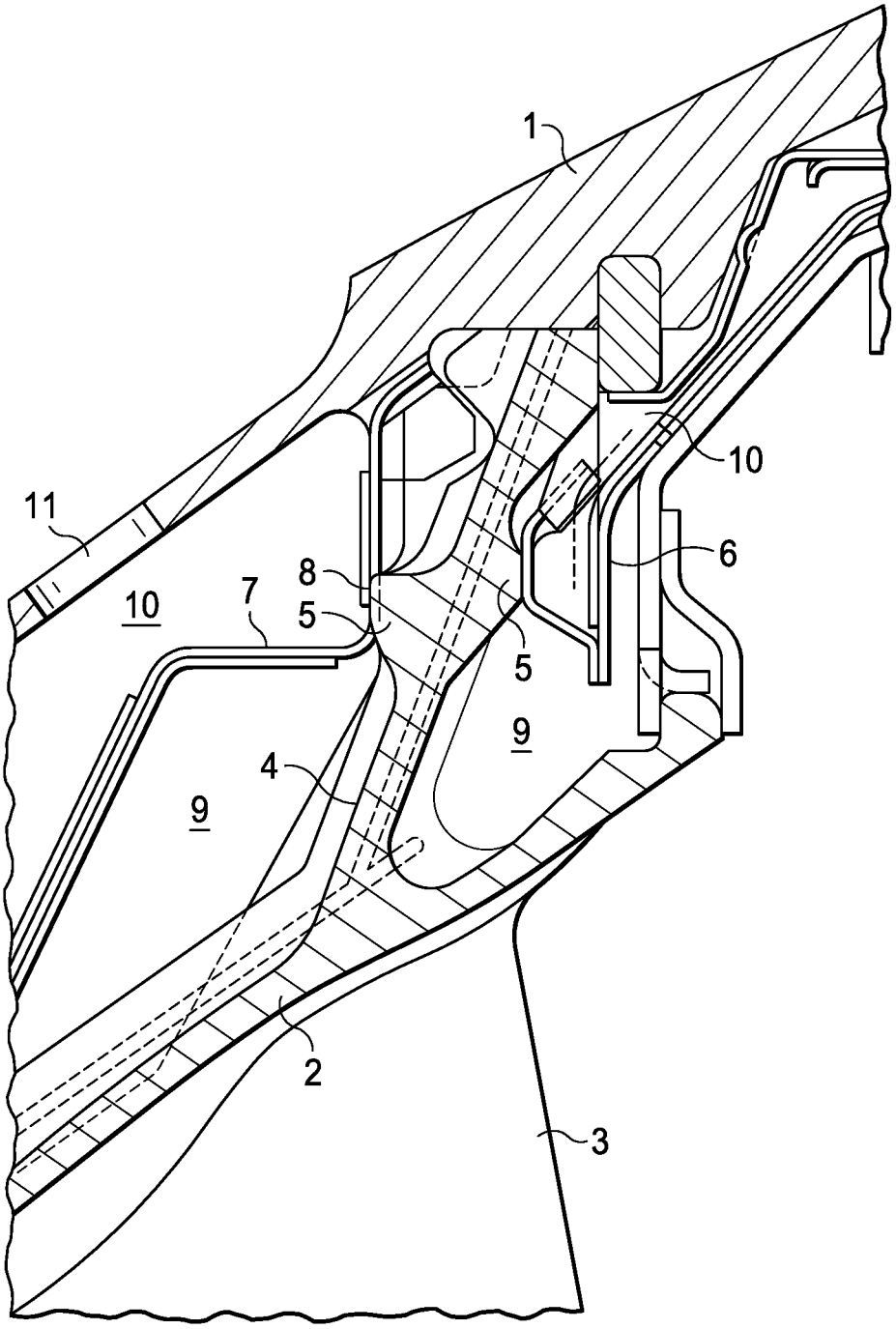
1
11
10
7
8
5
5
6
10
9
4
9
2
3

HOUSING STRUCTURE WITH IMPROVED SEAL AND COOLING

CROSS-REFERENCE TO RELATED APPLICATIONS

This application claims priority to and/or benefit of European Patent Application No. 12188313.6, filed Oct. 12, 2012, entitled GEHÄUSESTRUKTUR MIT VERBESSERTER ABDICHTUNG UND KÜHLUNG, the specification of which is incorporated by reference herein in its entirety.

TECHNICAL FIELD

The present invention relates to a housing structure for a turbo-engine, especially for a gas turbine or an aircraft engine.

BACKGROUND

In turbo-engines, such as gas turbines or aircraft engines, air is taken in along a flow channel, compressed, and, together with fuel, combusted in a combustion chamber, the combustion gases then being output via the flow channel in order to drive rotors in a turbine.

The flow channel is surrounded and enclosed by a housing structure. Very high temperatures prevail in the flow channel due to the combustion gases, especially in the area of the combustion chamber and the subsequent turbine, so that the housing structure surrounding the flow channel must be cooled efficiently in order for the operating temperatures to be as low as possible so that it is possible to employ materials with lower requirements for high temperature properties.

To this end, cooling air is guided into the area of the outer housing structure in order to cause the heat to dissipate. In addition, insulating elements and heat shields that are intended to protect the outer components from temperatures that are too high are used in such housing structures.

However, with such known housing structures there is often the need to provide cut-outs in the heat shields surrounding the flow channel in order to pass through them for instance nozzle ring bars or stator suspensions or circumferential securing elements in the radial direction. Using the cut-outs, however, it is possible for hot gas to escape from the flow channel to outside of it so that the temperature load on the components increases in the outer housing structures.

SUMMARY AND DESCRIPTION

It is therefore the object of the present disclosure to provide a housing structure that permits improved cooling of the outer housing components and thus decreases the temperature load on them.

This object is attained using a housing structure having the features as described and claimed herein and with a turbo-engine having the features as described and claimed herein. Advantageous embodiments are the subject-matter of the dependent claims.

The invention proceeds from the understanding that the cut-outs present in the prior art in the region of the heat shields or generally the presence of openings in the area of passages in the radial direction lead to the fact that an impermissibly great amount of hot gas can flow into the outer area of the housing structure. The invention therefore provides for arranging a seal in the area in which the heat shield is interrupted, so that hot gas is prevented from flowing towards the outer housing structure. It is also suggested that broadening elements be provided on bars or fixtures that are arranged on an inner housing wall and project at least somewhat radially outward, e.g. on guide vane bars or guide vane fixtures, and that on these broadening elements sealing faces be embodied against which heat shields are positioned in a sealing manner in order to attain a seal in this way.

Broadening elements shall be construed as expansions of the cross-section of a bar or fixture in at least one direction that runs in particular in a direction transverse to the radial direction, a cross-section reduction preferably also being provided in addition to the cross-section expansion so that the broadening element is present only in a specific segment of the bar or fixture.

By providing broadening elements on guide vane bars or guide vane suspensions or fixtures that are necessarily present, it is possible to attain an improvement in the seal in a simple manner since it is not necessary to provide any additional components that must be assembled and also the necessary modifications to the rest of the design are limited.

Due to the seal with at least one heat shield, preferably a plurality of heat shields, against vane guide or nozzle ring bars or vane guide or nozzle ring suspensions, it is furthermore possible to cause inner and outer chambers that are well separated from one another to be created, the inner chambers being present in the area of the inner housing wall and preferably spaced apart from the outer housing wall, while the outer chambers are present in the area of the outer housing wall and preferably spaced apart from the inner housing wall. Because of the separation of inner and outer chambers, it is possible to attain more efficient cooling, since the inner chambers act as buffers, while the cooling air guidance can be provided in the outer chambers. Using the buffers it is possible to prevent or at least reduce direct heat transfer from the flow channel to the outer housing structure.

The broadening element on a bar or fixture of the inner housing wall may be embodied in particular integrally so that additional assembly parts and additional assembly are not necessary. In particular the broadening element may be cast on a corresponding bar or fixture.

Preferably at least one broadening element may be provided on a bar that circumferentially encircles the flow channel or on a corresponding fixture of the inner housing wall on opposing sides that face away from one another, a heat shield being sealingly positioned against each broadening element so that a barrier wall that is made of heat shields and is as closed as possible for separating an outer part of the housing structure with outer chambers from an inner part of the housing structure with inner chambers is formed both in the axial direction and in the circumferential direction.

Thus extensive separation of the inner and outer chambers from one another is attained so that no hot gases or at least only a small amount of hot gases can travel from the flow channel or the inner chambers into the area of the outer chambers.

While the inner chambers are largely sealed in order to act as buffers, the outer chambers may have corresponding cooling air access openings in order to permit cooling air to flow in.

BRIEF DESCRIPTION OF THE DRAWINGS

The attached FIGURE provides a schematic partial sectional view of an inventive housing structure.

DETAILED DESCRIPTION AND EXEMPLARY EMBODIMENT

Additional advantages, characteristics, and features of the present invention shall be clarified in the following detailed description of an exemplary embodiment. The invention is not limited to this exemplary embodiment, however.

The attached FIGURE depicts a detail of an inventive housing structure having an outer housing wall 1 that can be embodied both in the axial direction and also can run segmented around the flow channel it delimits. Arranged in the area of the flow channel is a guide vane 3 that represents a part of the inner housing wall 2 in the form of a shroud. Arranged projecting obliquely outward from the guide vane 3 or the shroud and thus from the inner housing wall 2 is a guide vane bar 4 that may for example fix the guide vane 3 on the outer wall 1.

Provided between the outer housing wall 1 and the inner housing wall 2 are heat shields 6, 7 that are also embodied running around the flow channel, at least in part, and are to shield the outer housing wall 1 from the temperatures in the flow channel.

In the illustrated exemplary embodiment, the heat shields 6 and 7 delimit both the inner chambers 9 and the outer chambers 10.

The outer chambers 10 are delimited not only by the heat shields 6, 7, but also by the outer housing wall 1 and the guide vane bar 4. Provided in the outer housing wall 1 are some cooling air openings 11 that make it possible to guide air from the surroundings into the outer chambers 10 in order to provide cooling for the housing with respect to the high temperatures in the flow channel.

The heat shields 6, 7 furthermore delimit inner chambers 9 that are largely separated and sealed off from the outer chambers 10. To this end the guide vane bar 4 has broadening elements 5 bilaterally that are arranged integrally on the guide vane bar 4 and may be produced for instance immediately (i.e., directly) when the guide vanes 3 are cast. Provided on each broadening element 5 is a sealing face 8 that is in contact with the heat shield 7 or 6 in order to seal off the inner chambers 9 or outer chambers 10. By providing the broadening elements 5 on the guide vane bar 4 it is possible, in a simple manner and without complex major design modifications, to provide sealing faces for heat shields 6, 7 so that inner chambers 9 and outer chambers 10 that are well separated from one another are formed.

The inner chambers 9 are spaced apart from the outer housing wall 1 and the outer chambers 10 are spaced apart from the inner housing wall 2 so that the inner chambers 9 act as temperature buffers, while the outer chambers 10 are used for guiding cooling air.

Thus the outer housing wall 1 and the components in the area of the outer housing wall 1 may be effectively cooled and the temperature load can be reduced so that materials with lower requirements for temperature resistance may be employed.

Although the present invention has been described in detail using the exemplary embodiment, for one skilled in the art it is understood that the invention is not limited to this embodiment, but on the contrary modifications are possible such that individual features may be omitted or other combinations may be made as long as there is no departure from the protective scope of the attached claims. This disclosure includes all combinations of the individual features presented.

What is claimed is:

1. A housing structure for a turbo-engine having an outer housing wall and an inner housing wall, the inner and outer housing walls being spaced apart radially from one another and annularly enclosing an axial flow channel for the turbo-engine, the housing structure comprising:

a first heat shield and a second heat shield, both heat shields being disposed radially between the inner housing wall and the outer housing wall, and a bar projecting from an inner surface of the inner housing wall at least somewhat in a radial direction and extending to a radially outer end directly abutting an inner surface of the outer housing wall, the bar including first and second broadening elements disposed, respectively, on opposing sides of the bar that face away from one another, the first broadening element being an expansion of a first cross-section of the bar at a first radial location in a first direction transverse to the radial direction;

the second broadening element being an expansion of a second cross-section of the bar at a second radial location in a second direction transverse to the radial direction; and wherein each of the first and second broadening elements includes a respective sealing face against which the respective first and second heat shield is positioned in a sealing manner; and wherein each of the first and second broadening elements is disposed radially between the outer housing wall and the inner housing wall such that neither of the broadening elements contacts the outer housing wall or the inner housing wall;

wherein an inner radial side of each of the first and the second heat shields and the inner housing wall delimit, respectively, at least one inner chamber that is spaced apart from the outer housing wall; and wherein an outer radial side of each of the first and the second heat shields and the outer housing wall delimit at least one respective outer chamber that is spaced apart from the inner housing wall; and the respective inner chambers and the respective outer chambers are sealed off from one another.

2. A housing structure in accordance with claim 1, wherein the bar further comprises, in addition to the expansion of the cross-section of the bar at the respective first and second radial locations, a cross-section reduction at another radial location so that each of the first and second broadening elements is present only in a specific segment of the bar.

3. A housing structure in accordance with claim 1, wherein each of the first and second broadening elements is an integral portion of the bar, the respective broadening elements being cast thereon.

4. A housing structure in accordance with claim 1, wherein the outer housing wall includes at least one cooling air access opening into the at least one outer chamber.

5. A housing structure in accordance with claim 1, wherein the delimitation of the respective outer chambers further includes the respective sealing faces of the respective broadening elements.

6. A housing structure in accordance with claim 1, wherein the delimitation of the respective inner chambers further includes the respective sealing faces of the respective broadening elements.

7. A housing structure in accordance with claim 1, wherein:

the inner housing wall is formed by at least one part of a guide vane; and the bar is one of a guide vane bar or a guide ring bar or a stator suspension.

8. A turbo-engine comprising:

a combustion chamber;

a turbine; and a housing structure surrounding a flow channel extending between the combustion chamber and the turbine, the housing structure including a first heat shield and a second heat shield, both heat shields being disposed radially between an inner housing wall and an outer housing wall, and a bar projecting from an inner surface of the inner housing wall at least somewhat in a radial direction and extending to a radially outer end directly abutting an inner surface of the outer housing wall, the bar including first and second broadening elements disposed, respectively, on opposing sides of the bar that face away from one another, the first broadening element being an expansion of a first cross-section of the bar at a first radial location in a first direction transverse to the radial direction;

the second broadening element being an expansion of a second cross-section of the bar at a second radial location in a second direction transverse to the radial direction; and wherein each of the first and the second broadening elements includes a respective sealing face against which the respective first and second heat shield is positioned in a sealing manner; and wherein each of the first and second broadening elements is disposed radially between the outer housing wall and the inner housing wall such that neither of the broadening elements contacts the outer housing wall or the inner housing wall;

wherein an inner radial side of each of the first and the second heat shields and the inner housing wall delimit, respectively, at least one inner chamber that is spaced apart from the outer housing wall; and wherein an outer radial side of each of the first and the second heat shields and the outer housing wall delimit at least one respective outer chamber that is spaced apart from the inner housing wall; and the respective inner chambers and the respective outer chambers are sealed off from one another.

9. A turbo-engine in accordance with claim 8, wherein the bar further comprises, in addition to the expansion of the cross-section of the bar at the respective first and second radial locations, a cross-section reduction at another radial location so that each of the first and second broadening elements is present only in a specific segment of the bar.

10. A housing structure for a turbo-engine having a combustion chamber, a turbine and a flow channel extending between the combustion chamber and the turbine, the housing structure comprising:

an outer housing wall;

an inner housing wall spaced radially apart from the outer housing wall, the inner and outer housing walls annularly enclosing the flow channel;

a first heat shield and a second heat shield, both heat shields being disposed radially between the inner housing wall and the outer housing wall; and a bar projecting from an inner surface of the inner housing wall at least somewhat in a radial direction and extending to a radially outer end directly abutting an inner surface of the outer housing wall, the bar including first and second broadening elements disposed, respectively, on opposing sides of the bar that face away from one another, each of the first and second broadening elements being an expansion of a respective cross-section of the bar at, respectively, a first radial location and a second radial location in a respective direction transverse to the radial direction, wherein the bar comprises a cross-section reduction at another respective radial location so that the respective broadening element is present only in a specific segment of the bar, and wherein each respective broadening element includes a respective sealing face against which the respective heat shield is positioned in a sealing manner, and wherein each of the first and second broadening elements is disposed radially between the outer housing wall and the inner housing wall such that neither of the broadening elements contacts the outer housing wall or the inner housing wall;

wherein an inner radial side of each of the first and the second heat shields and the inner housing wall delimit, respectively, at least one inner chamber that is spaced apart from the outer housing wall; and wherein an outer radial side of each of the first and the second heat shields and the outer housing wall delimit at least one respective outer chamber that is spaced apart from the inner housing wall; and the respective inner chambers and the respective outer chambers are sealed off from one another.

* * * * *